United States Patent [19]

Elko et al.

[11] Patent Number: 4,628,638

[45] Date of Patent: Dec. 16, 1986

[54] CANTILEVER-TYPE SLIDE GATE

[75] Inventors: Dennis J. Elko; Ronald J. DiMedio, both of West Chester, Pa.

[73] Assignee: International Gate Devices, Inc., Folsom, Pa.

[21] Appl. No.: 756,608

[22] Filed: Jul. 19, 1985

[51] Int. Cl.[4] ..... E05D 15/06; E04G 3/00

[52] U.S. Cl. ..... 49/426; 49/425; 248/230

[58] Field of Search ..... 49/426, 427, 235, 425, 49/404, 452, 453; 248/230, 225.31

[56] References Cited

U.S. PATENT DOCUMENTS 1,225,301 5/1917 Wolfe ..... 248/230

3,531,895 10/1970 Appell ..... 49/360

OTHER PUBLICATIONS

Anchor Fence Post Products Flyer, copyright 1978.

*Primary Examiner*—Kenneth J. Dorner

*Assistant Examiner*—Gerald Anderson

*Attorney, Agent, or Firm*—Eugene E. Renz, Jr.

[57] ABSTRACT

A support system for a gate assembly including a frame having an upper rail adapted to be mounted adjacent an opening in a fence and actuatable between an open position exposing the gate opening and a closed position overlying the gate opening comprising an elongated hollow channel member defining a trackway having a downwardly depending elongated slot in the lower face of the channel member, a longitudinally extending side face of the channel having a configuration conforming generally to the contour of the upper rail of the gate, at least one bracket having a portion conforming to the contour of the upper rail and bolt means securing the upper rail of the gate assembly between the channel member and bracket, and at least one truck having roller means mounted on a post comprising part of the fence assembly adjacent the gate opening engageable in said trackway permitting movement of the gate assembly relative to the opening between open and closed positions.

5 Claims, 9 Drawing Figures

10
14
16
20
22
30
70
G
O 70
70
70
15
12
50
G
14
122
12
50
16
122
3
3
34
20
20
20
20
15
24
16
134
134
22
20
0

110
106
B
A
100
102
124
120
125
34
104
112
108
50
16
82
54
38
74
76
78
62
64
70
44
42
56
60
46
32
36
50
40
48
72
20

CANTILEVER-TYPE SLIDE GATE

FIELD OF THE INVENTION

The present invention relates to cantilever-type slide gate assemblies and more particularly to a novel support system for assemblies of this type which is readily adaptable to support a gate made of a generally rectangular frame and support members made of conventional pipe-type tubing and conventional chain link fencing supported within the periphery of the frame.

BACKGROUND OF THE INVENTION

The present invention is an improvement over prior cantilever-type gate assemblies principally by reason of the fact that it is more economical to assemble and install, is safer and may be adapted readily to a gate comprised of conventional pipe tubing welded in a rectangular configuration and having conventional chain link fencing covering the opening in the frame. In accordance with a prior known cantilever gate assembly, the gate assembly is supported for transverse movement between an open and closed position between upper and lower rollers supported on fence posts adjacent the gate opening. While these systems are generally simple and economical they present certain disadvantages and drawbacks. For example, since the rollers are exposed to the elements, it has been found that snow and ice which may accumulate on the rollers causes freezing or jamming of the gate assembly. Furthermore, exposed rollers present a safety hazard to humans particularly children who may playfully hang from a horizontal support of the gate and ride the gate back and forth and in this process have their hands jammed between the horizontal frame members and the support rollers.

These prior roller supported gate assemblies include essentially four spaced rollers, two upper rollers which engage the top rail of the gate assembly and two spaced lower rollers which engage the bottom rail. In this type of gate mounting, the amount of sag depends on the precise geometry of the gate frame. Thus, if the gate frame is out of line or if there is too much clearance, large sag results when the gate is at opposite closed or open limit positions. On the other hand, if the sliding fit between the rollers and the upper and lower frame members of the gate is too tight, the gate binds and is extremely difficult to actuate and in some instances may bind to a point where it will jam or lock.

In these prior roller support systems, it has been found that it is necessary to make the gate frame of a heavy sturdy construction to minimize compression or crushing effects between the gate and roller when it is in its fully cantilevered open or closed position.

Furthermore, it has been found that these gate assemblies are generally cumbersome and difficult to operate and exhibit a large amount of sag particularly in gates for large openings often necessitating support or guide means in the form of rollers which engage the surface in the gate opening to help support the weight of the gate.

Another prior cantilever-type gate assembly is shown in Ashworth U.S. Pat. No. 3,705,468 issued Dec. 12, 1972. This assembly is rather sophisticated and hence costly to manufacture and install. Furthermore, the trackway opens upwardly and, therefore, is exposed to ingress of foreign matter such as dirt which may jam the operation. Additionally, this construction does not foreclose accumulation of snow in the channel which likewise could affect normal operation of the gate system.

Another prior sliding gate assembly is shown in the Case U.S. Pat. No. 3,394,497. This system is a vertical system and incorporates pulleys in a rather complicated and complex trackway system requiring a special gate construction. This system is not adapted to simple pipe-type gate assembly for which the present invention is particularly adapted. Furthermore, the cooperating mechanisms are exposed to the environment thereby presenting the problems noted above in inclement weather in connection with the Ashworth Patent.

SUMMARY OF THE INVENTION

With the foregoing in mind, the present invention is designed to overcome the disadvantages and drawbacks of prior cantilever-type gate assemblies discussed above. To this end, the gate support assembly comprises an elongated trackway adapted to be secured to the horizontal upper support member of the gate frame by a series of brackets, the trackway being of generally rectangular cross section having an elongated slot in its lower face to accommodate truck members which are in turn supported on spaced posts, one of which defines one side of the gate opening. Each truck member includes an elongated one-piece body member having rotatably mounted guide rollers cooperating with the walls defining the trackway to support and guide the gate during actuation between open and closed positions. The truck and trackway are of a predetermined configuration to allow small controlled lateral motions of the gate to ensure smooth movement without jamming or binding and a minimum of sag even in the most extreme cantilevered position of the gate in the fully open and closed positions.

By contrast to the roller supported gate assemblies, the support system of the present invention ensures easy opening and closing movements of the gate irrespective of the gate geometry since the support system is attached only to the upper frame member. Further, the slight rocking or pivoting movement permitted by the clevis pin mounting for the truck provides for a good weight shift when actuating the gate in either direction.

Again by contrast to the roller supported gate assemblies, the support system of the present invention mounts readily onlky to the upper rail of a standard gate assembly which, therefore, can be made significantly lighter and which is less costly to manufacture and easier to operate since there are no crimping or compression forces on the gate assembly per se at the extreme cantilevered positions.

Additionally in these roller supported gate systems, too great a clearance between the rollers and the upper and lower frame members of the gate which may result over a period of years due to the distortion of the gate assembly by reason of the compression forces in the extreme cantilevered positions may result in release of the gate assembly from the roller system and this presents an additional hazard and adds to the cost of maintenance.

The present invention incorporates features which distinguish the support system from the prior art and provide certain advantages over prior gate assemblies. For example, the system comprises relatively few parts which are easy and economical to manufacture, the parts being in the nature of a retrofit so that they can be assembled readily to standard, simple gate configurations. This obviates the need for special gate designs.

The parts comprising the system can be packed compactly and assembled to a standard gate at the site thus reducing shipping and handling costs. Further, the system is designed for easy trouble-free operation and safety by reason of the fact that the trucks nest completely in the enclosed trackway and, therefore, are not an exposed hazard as in prior exposed roller-type support systems. Moreover, operation of the gate is not impeded by weather conditions such as ice and snow since the cooperating interengaging elements of the system are shielded by the novel configuration of trackway and trucks and further by reason of the suspension parts of the system being located adjacent the top edge of the gate remote from the ground. Further, the parts comprising the system are not complicated and may be effectively assembled even by relatively unskilled mechanics.

In accordance with the present invention, the gate is captive by the support system and by reason of this arrangement, it exhibits a minimum sag even in the extreme cantilevered open or closed position. Furthermore, the support system of the present invention is adapted to conventional gates of a variety of sizes and may be easily and quickly assembled to the gate at the site in the field.

BRIEF DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENT

Figures 1A, 2A:
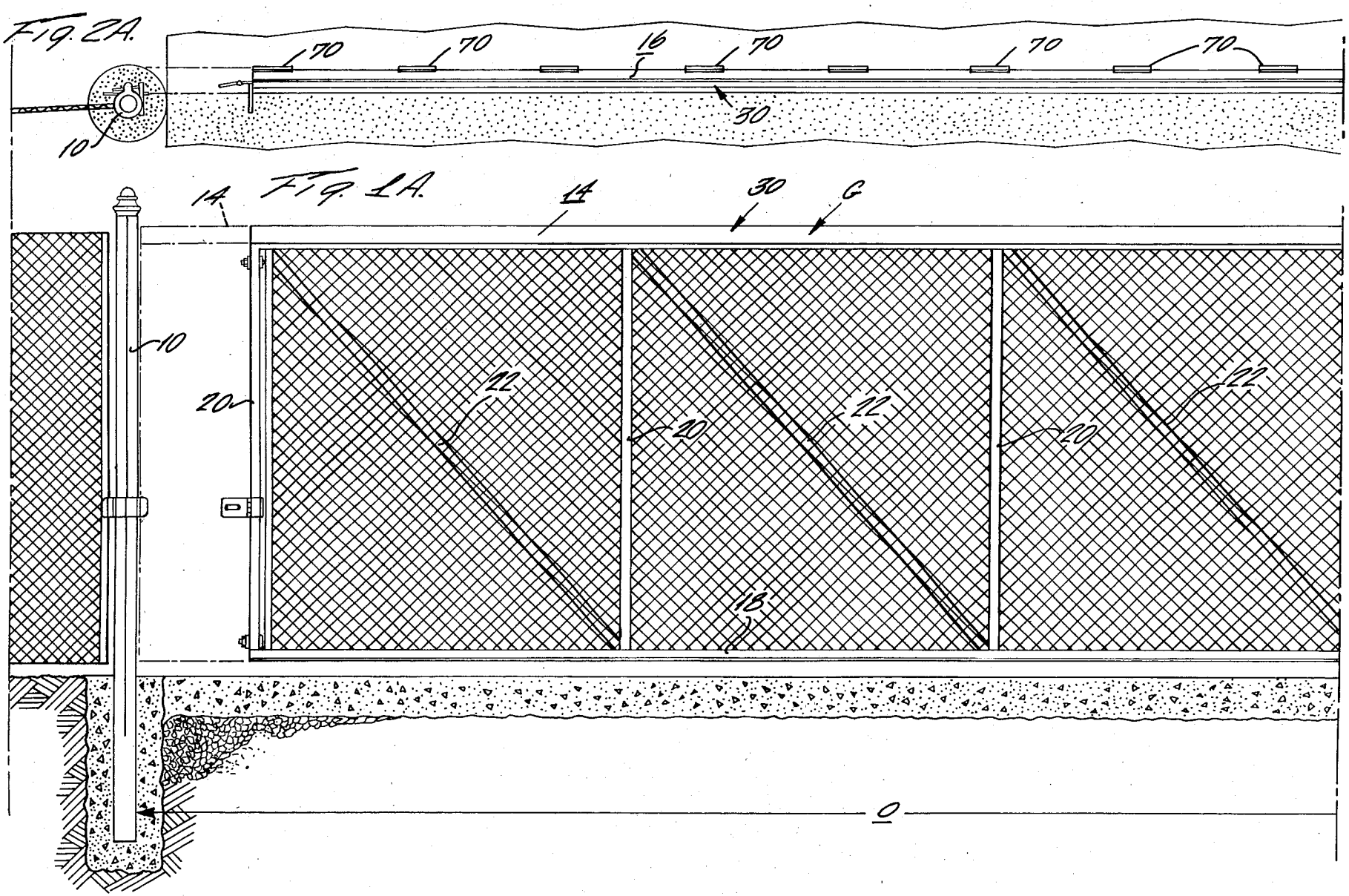
FIGS. 1*a* and 1*b* are a side elevational view of a cantilever gate assembly and support mechanism in accordance with the present invention.
FIGS. 2*a* and 2*b* are top plan views of the cantilever gate assembly and support mechanism shown in FIGS. 1*a* and 1*b;*
Figures 1B, 2B:
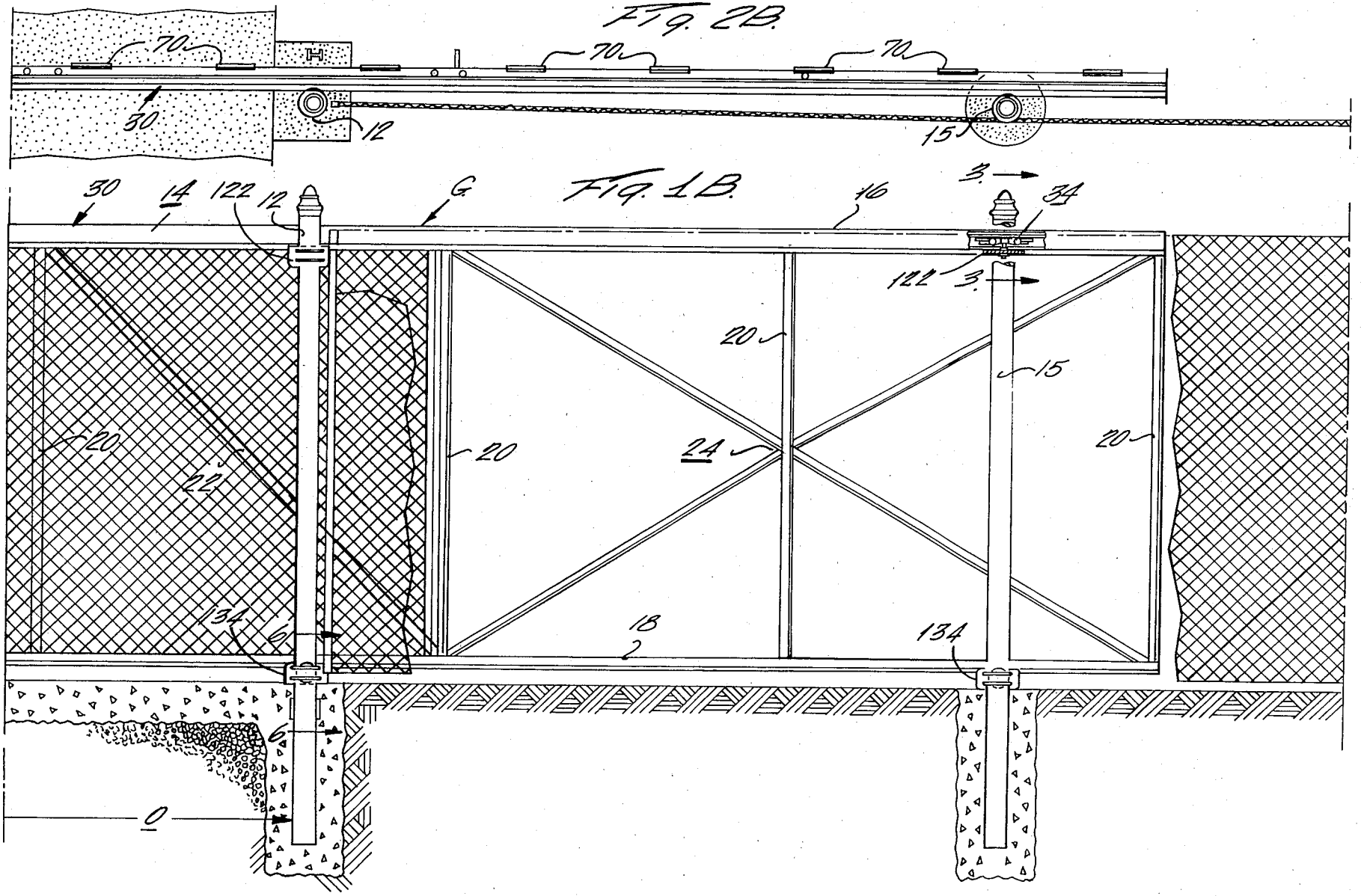
Figure 4:
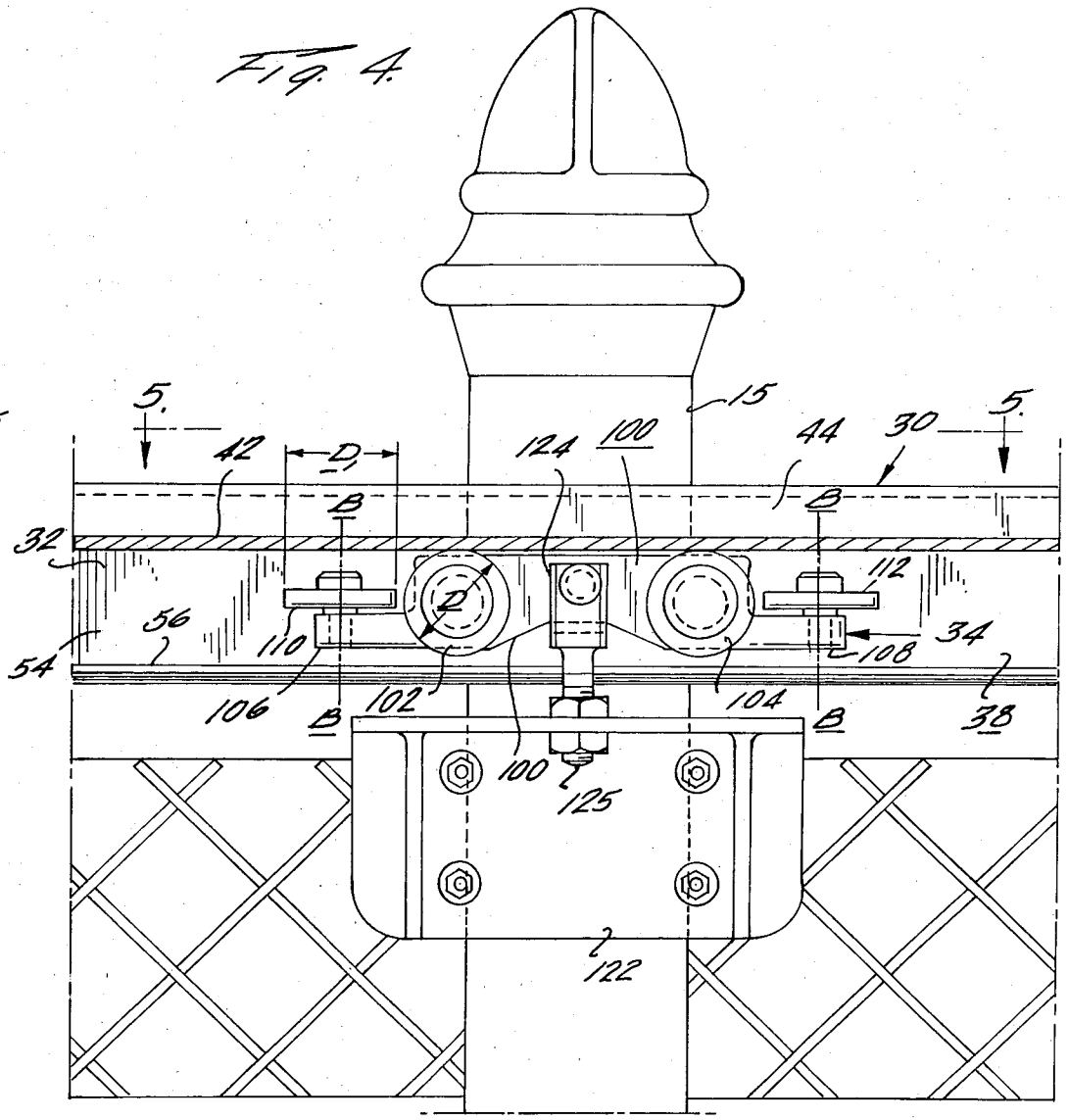
FIG. 4 is a sectional view taken on lines 4—4 of FIG. 3.

Referring now to the drawings and particularly to FIGS. 1*a*, 1*b*, 2*a* and 2*b*, there is illustrated a cantilever-type gate assembly incorporating the novel support system of the present invention. The gate G is adapted for movement between a closed position extending across the gateway opening O defined by a pair of spaced upright gate posts 10 and 12 suitably mounted in concrete footings and a retracted open position to one side of the gateway opening O. The gateway opening O may vary between about 4′ to 30′ and the support system of the present invention is operative to support the gate G in a manner providing easy opening and closing with essentially no sag.

The gate G as illustrated comprises a generally rectangular frame 14 consisting of generally parallel spaced upper and lower tubular frame members 16, 18 and vertical tubular frame members 20 connected to the upper and lower frame members, for example by welding. The frame members may be made of tubular aluminum or galvanized steel of circular cross section. The gate assembly also includes cross ribs 22 and a counterweight section 24 at one end of the gate G. The opening in the frame is covered by suitable fencing such as chain link fabric.

Figure 3:
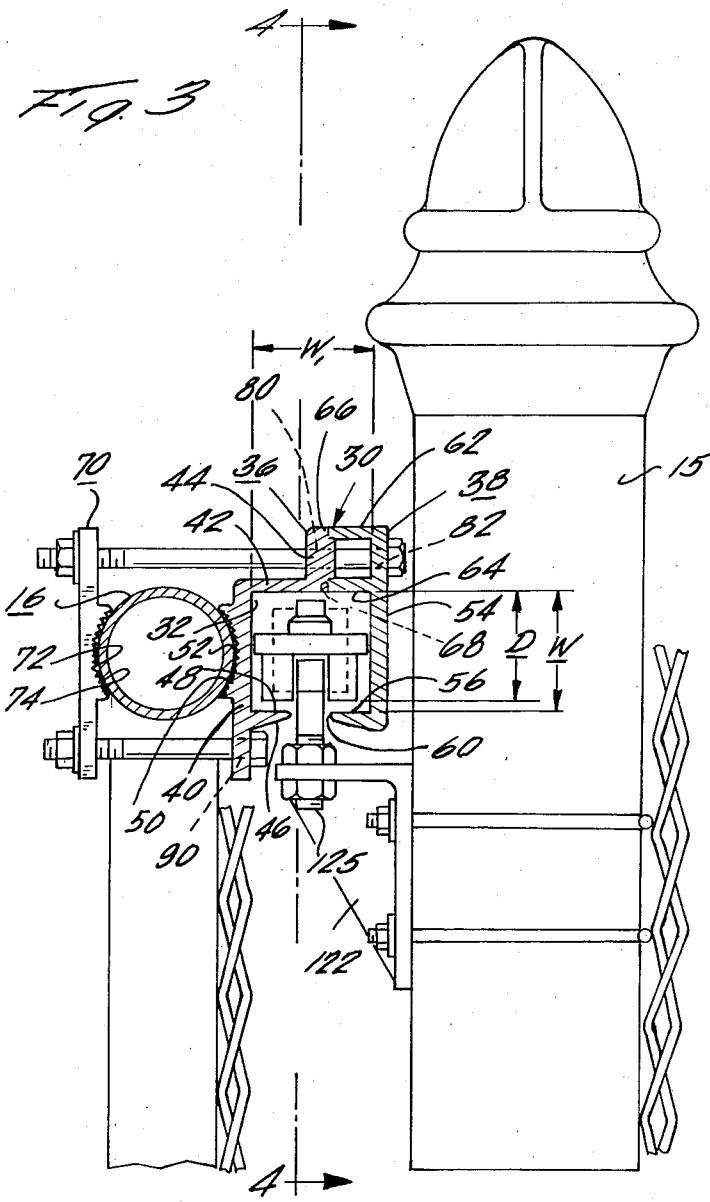
FIG. 3 is an enlarged fragmentary sectional view taken on lines 3—3 of FIG. 1*b;*
Figure 5:
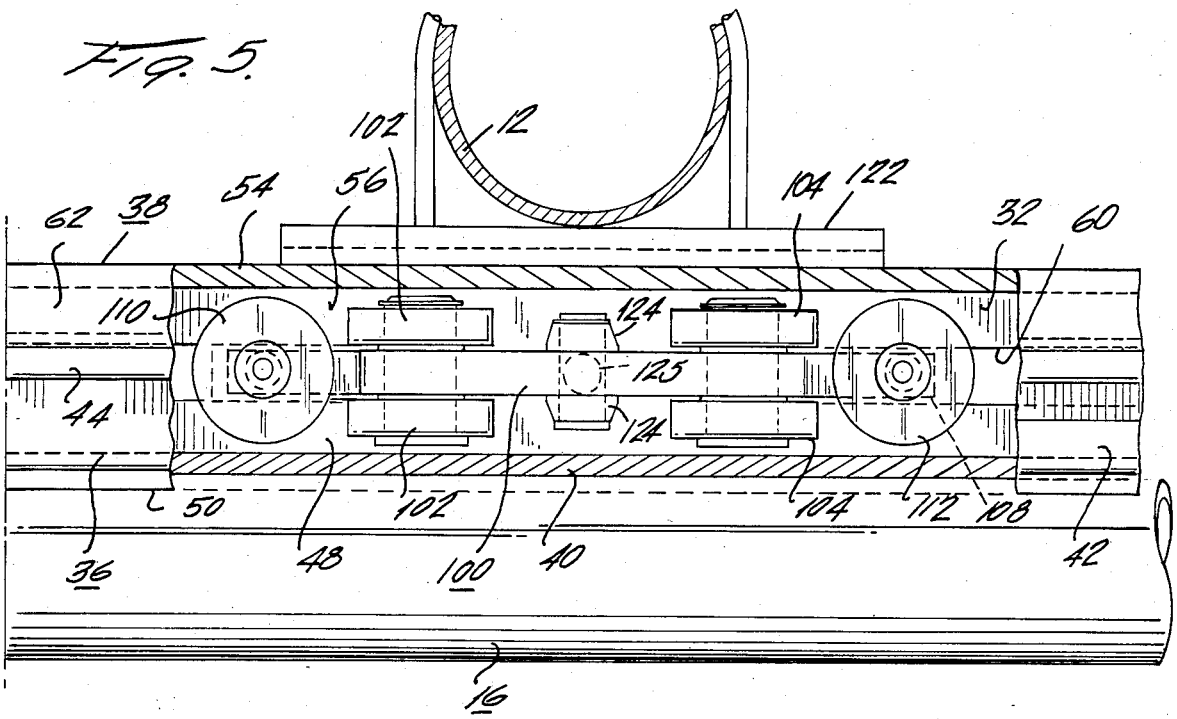
FIG. 5 is a sectional view showing the truck assembly for the support system of the present invention taken on lines 5—5 of FIG. 4.
Figure 7:
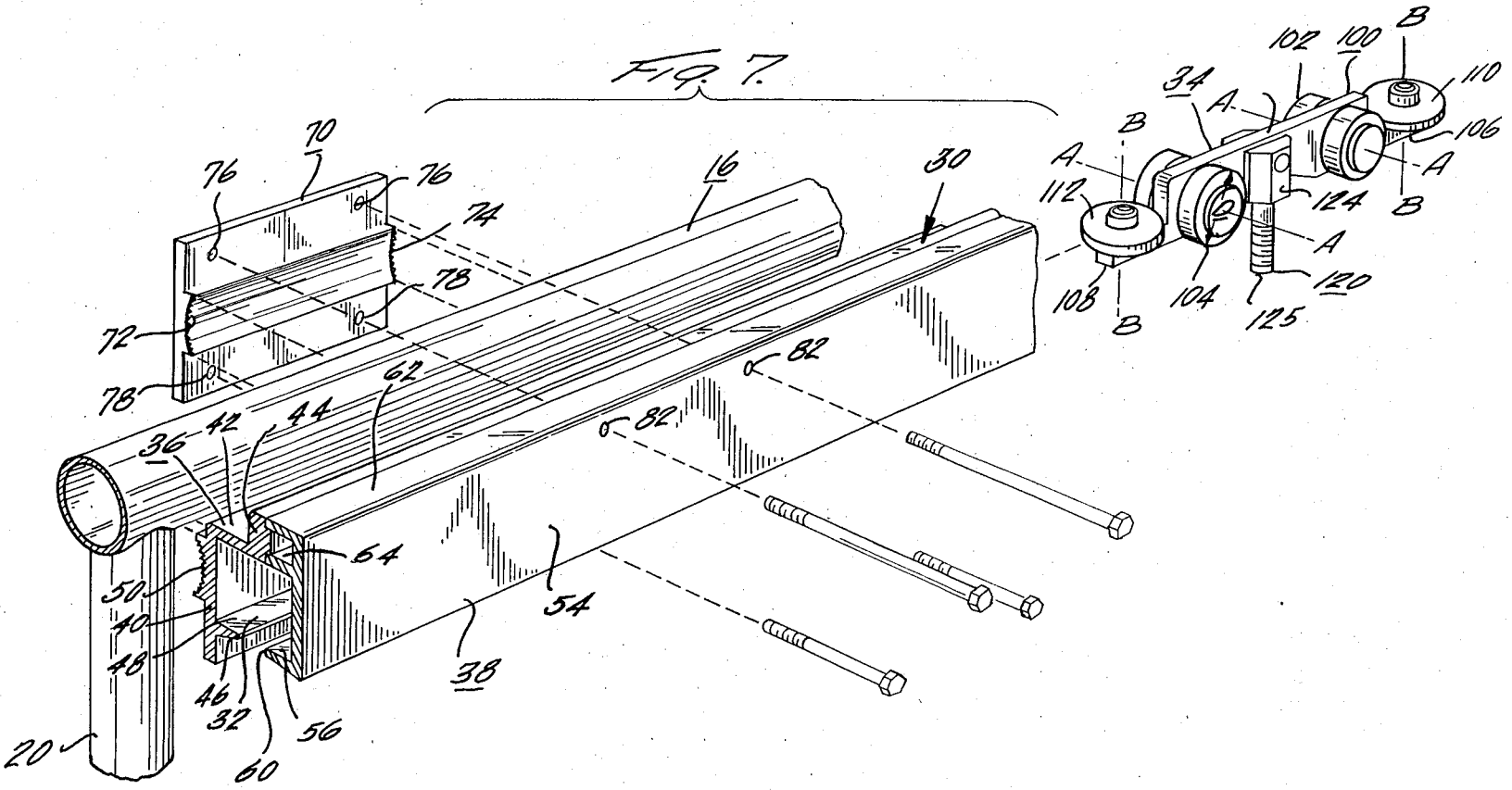
FIG. 7 is an exploded perspective view illustrating in greater clarity the support mechanism of the present invention.

The support system of the present invention is comprised of relatively few parts which are easy and economical to manufacture and which may be adapted and assembled to conventional fence and gate assemblies. To this end, the support system comprises, as best illustrated in FIGS. 3 and 7, an elongated hollow channel member 30 defining a trackway 32 mounted to the upper frame member 16 of the gate G and truck assemblies 34, 34 mounted to the spaced outer fence support post members 12 and 15 at one side of the gate opening O. The truck assemblies 34 as illustrated engage in the trackway 32 to support the gate for movement between open and closed positions.

The channel member 30 as illustrated comprises a pair of interfitting channel sections 36 and 38. The channel section 36 comprises an elongated generally rectangular sidewall 40, having an upper wall 42 and a radially outwardly directed boss 44. A flange 46 projects inwardly from the face of the sidewall 40 and defines a lower rail segment 48 for the trackway 32. The outer face of the wall 40 has, in the present instance, a longitudinally extending arcuate seat 50 which conforms and complements the outer peripheral shape of the top rail to snugly embrace the same in the manner described in more detail below. The seat has a plurality of longitudinally extending circumferentially spaced ribs 52 to firmly embrace the top rail of the gate in the assembled position to resist slippage. The channel section 38 as illustrated includes an elongated generally rectangular sidewall 54 having at its lower terminal edge an inwardly directed flange 56 which is aligned with the flange 48 and spaced therefrom to define a slotted opening 60 extending the length of the channel member. The channel section 38 also includes a pair of inwardly directed spaced flanges 62 and 64 at its upper end which engage in notched recesses 66, 68 in the face of the boss 44 on opposite sides of openings therein for bolt fasteners. The two-piece construction of the channel member of the present invention facilitates ease of manufacture, for example, by forming in a simple extruding process. Furthermore, the interfitting configuration of the components ensures a good firm mounting to the frame member of the gate.

The support assembly further includes a number of generally rectangular brackets 70, each bracket having an arcuate seat 72 conforming to the contour of the upper rail and having longitudinally directed ribs 74 to provide a strong grip and resist twisting of the upper rail of the gate when it is assembled in the manner illustrated. Each of the plates has a series of bolt holes 76 and 78 therein on either side of the seat 72 which align with the bolt holes in the channel member and straddle the upper rail of the gate to firmly secure it in place to the upper rail. Specifically, the bolt holes 76 are aligned with openings 80 in the boss 44 and openings 82 in the channel member 38 between flanges 62 and 64. The bolt holes 78 align with bolt holes 90 adjacent the lower edge of channel member 36 below the flange 46.

The support system of the present invention is relatively simple and easy to mount on the gate assembly in the following manner. The channel member 33 is positioned on one side of the upper gate rail 16 facing the support posts 12 and 15 so that the sidewalls 40 and 54 are generally parallel to the plane of the gate frame, and a series of brackets 70 are positioned on the opposite side of the upper gate rail 16 so that they lie generally parallel to the plane of the gate. Bolts 71 are engaged through the aligned openings in the channel member and support brackets and firmly secured by turning the nuts 73 to tightly embrace the upper guide rail between the channel and brackets. The guide brackets 70 are preferably spaced approximately 30" apart. Thereafter, the gate is simply positioned so that the trackway telescopes over the trucks 34 mounted on the guide posts 12 and 15. The gate is now ready for use.

Each truck assembly 34 as best illustrated in FIGS. 3, 4, 5 and 7 comprises an elongated one-piece body member 100 for mounting sealed bearing assemblies 102, 104 about horizontal axles A—A. The body member 100 also has projected end portions 106 and 108 which mount guide rollers 110, 112 about an axis B—B transverse to the axis A—A of the bearings and which are generally aligned with the center line of the bearings so that they engage approximately midway the height in the trackway defined by the channel members. Each truck is supported for limited pivotal movement on a clevis pin 120 which is mounted on angle brackets 122 secured to the fence posts 12 and 15. The clevis pin 120 comprises a yoke portion 124 which straddles the body member 100 and is configured to allow a slight rocking motion of the truck. Note that the reduced shank 125 of the clevis pin is of a cross section somewhat smaller than the slotted opening 60 in the trackway to allow a degree of free travel movement of the channel member relative to the fixed truck in a lateral direction. Note further that the bearing rollers are of a diameter D slightly smaller than the distance W between the upper wall of the channel and the bottom rails to minimize the amount of sag when moving the gate between open and close positions. Likewise, the side thrust rollers are of a predetermined diameter $D_1$ slightly less than the width $W_1$ of the trackway to minimize lateral rocking movement of the gate. The small control lateral play between the truck assemblies and the opening in the trackway ensures smooth operation and prevents binding which may result as a result of extreme temperature variations which may affect expansion or contraction of the trackway.

Figure 6:
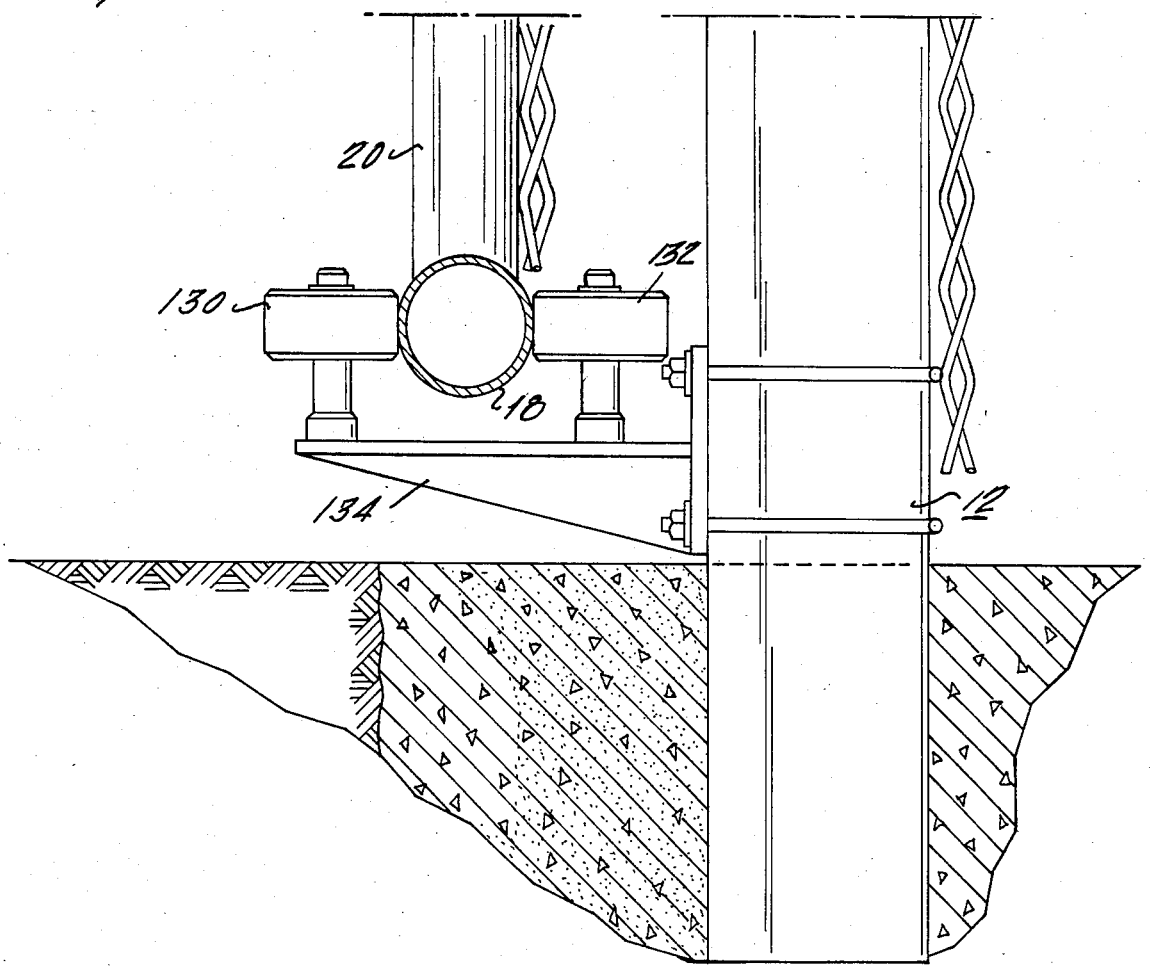
FIG. 6 is an enlarged fragmentary view showing the lower guide means for a gate assembly in accordance with the present invention.

Suitable guide means may be provided which straddles the lower horizontal frame member 18 of the gate to provide additional control for limiting pendulum movement of the gate. The guide means as illustrated in FIG. 6 comprises a pair of spaced rollers 130, 132 which are rotatably mounted on a bracket 134 supported on the fence posts 12 and 15 adjacent the gate opening O.

While a particular embodiment of the invention has been illustrated and described herein, it is not intended to limit the invention and changes and modifications may be made therein within the scope of the following claims. For example, even though the support system has been illustrated and described herein with a gate assembly having tubular rails of circular cross section, the principle of the invention applies equally to gate frame constructions of different cross sectional configurations, for example square or rectangular. In this case, the configuration of the arcuate seats of the channel member and bracket are simply modified to conform to the external configuration of the upper rail of the gate assembly.

What is claimed is:

1. A retrofit assembly converting a generally rectangular frame assembly comprising peripheral pipe elements including an upper horizontal rail and fencing spanning the pipe elements for use as a gate assembly mounted adjacent a gate opening in a fence and actuatable between open and closed positions comprising an elongated channel member secured to the upper rail of the frame assembly in generally parallel alignment therewith, said channel member having an elongated slot formed therein also parallel to the upper rail of the frame assembly and defining a trackway having a downwardly depending slot in a lower face of the channel member, a longitudinally extending side face of said channel member having a configuration conforming generally to the contour of the upper rail of the gate, at least one bracket having a portion conforming to the contour of the upper rail and bolt means securing the channel member and bracket to the upper rail of said frame assembly and at least one truck having roller means mounted on a post comprising part of the fence assembly adjacent the gate opening engaging said trackway and facilitating movement of the gate assembly relative to the gate opening between open and closed positions.

2. A support system as claimed in claim 1 wherein said channel member comprises a pair of interfitting sections.

3. A support system as claimed in claim 1 wherein the side face of the channel member and the portion of said bracket conforming to the contours of the upper rail are of arcuate cross section and include a plurality of longitudinally extending spaced ribs serving as gripping members.

4. A support system as claimed in claim 1 wherein said truck comprises a one-piece body portion and a plurality of rollers at opposite ends of said body portion to guide the truck in the trackway longitudinally and transversely.

5. A support system as claimed in claim 4 including a clevis pin fixed to a fence support post adjacent the gate opening and pivotally mounted to the body portion of the truck.

* * * * *